US005088564A

United States Patent [19]

Kobayashi

[11] Patent Number: 5,088,564

[45] Date of Patent: Feb. 18, 1992

[54] METHOD OF AND APPARATUS FOR DRIVING PILES

[75] Inventor: Yoshiaki Kobayashi, Toyma, Japan

[73] Assignee: Kobayashi Construction Co., Ltd., Toyama, Japan

[21] Appl. No.: 695,277

[22] Filed: May 3, 1991

[30] Foreign Application Priority Data

Jun. 2, 1990 [JP] Japan ..... 2-145165

[51] Int. Cl.[5] ..... E02D 7/00

[52] U.S. Cl. ..... 173/1; 173/162.1; 173/DIG. 2

[58] Field of Search ..... 173/1, 162.1, DIG. 2

[56] References Cited

U.S. PATENT DOCUMENTS 3,861,494 1/1975 Grego ..... 181/33 A
4,262,755 4/1981 Kuhn ..... 173/131

FOREIGN PATENT DOCUMENTS 0059798 9/1982 European Pat. Off. ..... 173/DIG. 2
0135228 8/1983 Japan ..... 173/DIG. 2
0109690 4/1990 Japan ..... 173/DIG. 2

*Primary Examiner*—Douglas D. Watts
*Assistant Examiner*—John M. Husar
*Attorney, Agent, or Firm*—Frishauf, Holtz, Goodman & Woodward

[57] ABSTRACT

A pile driver is disclosed, in which an adapter for transmitting the hammering force of a hammer provided in a hydraulically driven vibrator to a member to be driven into the ground is provided between the hammer and driven member. The adapter is formed with an oil accommodation section, in which a head portion to be hammered by the hammer is formed. The oil accommodation section is filled with oil such that the head portion is immersed in oil. A cooling unit is provided such that it surrounds the adapter. A cooling medium is circulated through the cooling unit by a circulating unit.

20 Claims, 6 Drawing Sheets

METHOD OF AND APPARATUS FOR DRIVING PILES

BACKGROUND OF THE INVENTION

1. Field of the Invention

This invention relates to a method of and an apparatus for driving piles, steel pipes, corrugated steel plates, etc., into the ground by exerting impacts.

2. Description of the Prior Art

Driving piles, steel piles, corrugated steel plates, etc., into the ground or pulling out these members from the ground is frequently required in construction work. Usually, the operation of driving a pile into the ground or pulling it out of the ground is carried out by using a special machine, such as a vibratory pile driver, or a press pile driver, or by suspending a pile driver, which has a chuck provided on a vibrator, from a crane or a power shovel boom end.

However, the conventional special machines such as vibratory and press pile drivers are expensive and require high maintenance and operating costs. In addition, these machines are large and are very cumbersome to transport into and out of sites of medium scale works. Further, since they are large in size, they generate extreme vibrations and noise and, in extreme cases, cause cracks in neighboring buildings.

Great vibrations and noise are also generated from a pile driver which is suspended from a crane or a power shovel, and these vibrations can also be propagated to neighboring places and may cause cracks or the like in buildings in these places.

SUMMARY OF THE INVENTION

An object of the present invention is to provide a method of and an apparatus for driving piles, which permits of a very quiet operation generating very slight vibrations when driving piles, steel pipes, corrugated steel plates, etc. This object is attained with a pile driver adapter which is simple in construction and, in combination with a pile driver, permits construction work to be carried out efficiently in places close to dwelling areas or to buildings without generating much noise or being hazardous of causing damage to buildings.

According to the invention, there is provided a method of driving a member into the ground by hammering a head of the member, which comprises the steps of providing a hammer for driving the head of the driven member, providing a vibrator for providing an impact force to the hammer, providing between the hammer and the driven member an adapter for transmitting the hammering force of the hammer to the driven member, providing the adapter with an oil accommodation chamber, providing the oil accommodation chamber with a head portion to be hammered by the hammer, filling the oil accommodation chamber with oil to a level above the head portion, and causing striking of the head portion with said hammer while cooling the neighborhood of the adapter, thereby effecting the driving of the driven member with the hammer.

According to the invention, there is also provided an adapter for use between a pile driving hammer and a driven member for driving the member into the ground by hammering a head of the member.

According to the invention, there is further provided a pile driver in which an adapter for tranmitting the hammering force of a hydraulically driven vibrator to a member to be driven into the ground is provided between the hammer and the driven member, the adapter being formed with an oil accommodation chamber in which a head portion to be hammered by the hammer is formed and which is partially filled with oil to a level such that the head portion is immersed in oil, a cooling unit being provided such as to surround the adapter, and a cooling medium circulated through the cooling unit by a circulating unit.

DETAILED DESCRIPTION OF THE PREFERRED EMBODIMENTS

Preferred embodiments of the invention will now be described with reference to the drawings.

Figure 1:
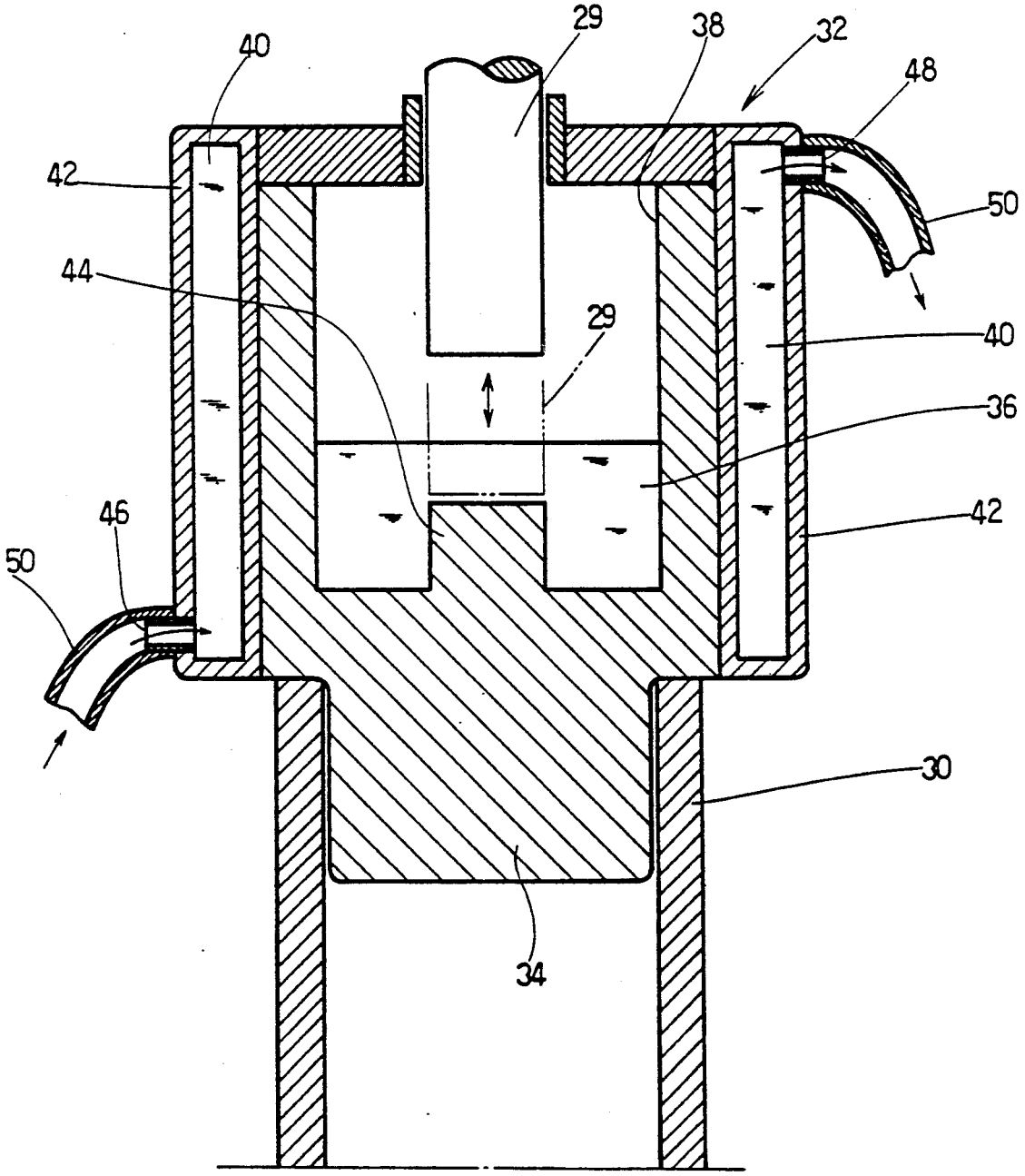
FIG. 1 is a sectional view showing a hammer unit and an adapter in a first embodiment of the invention.
Figure 2:
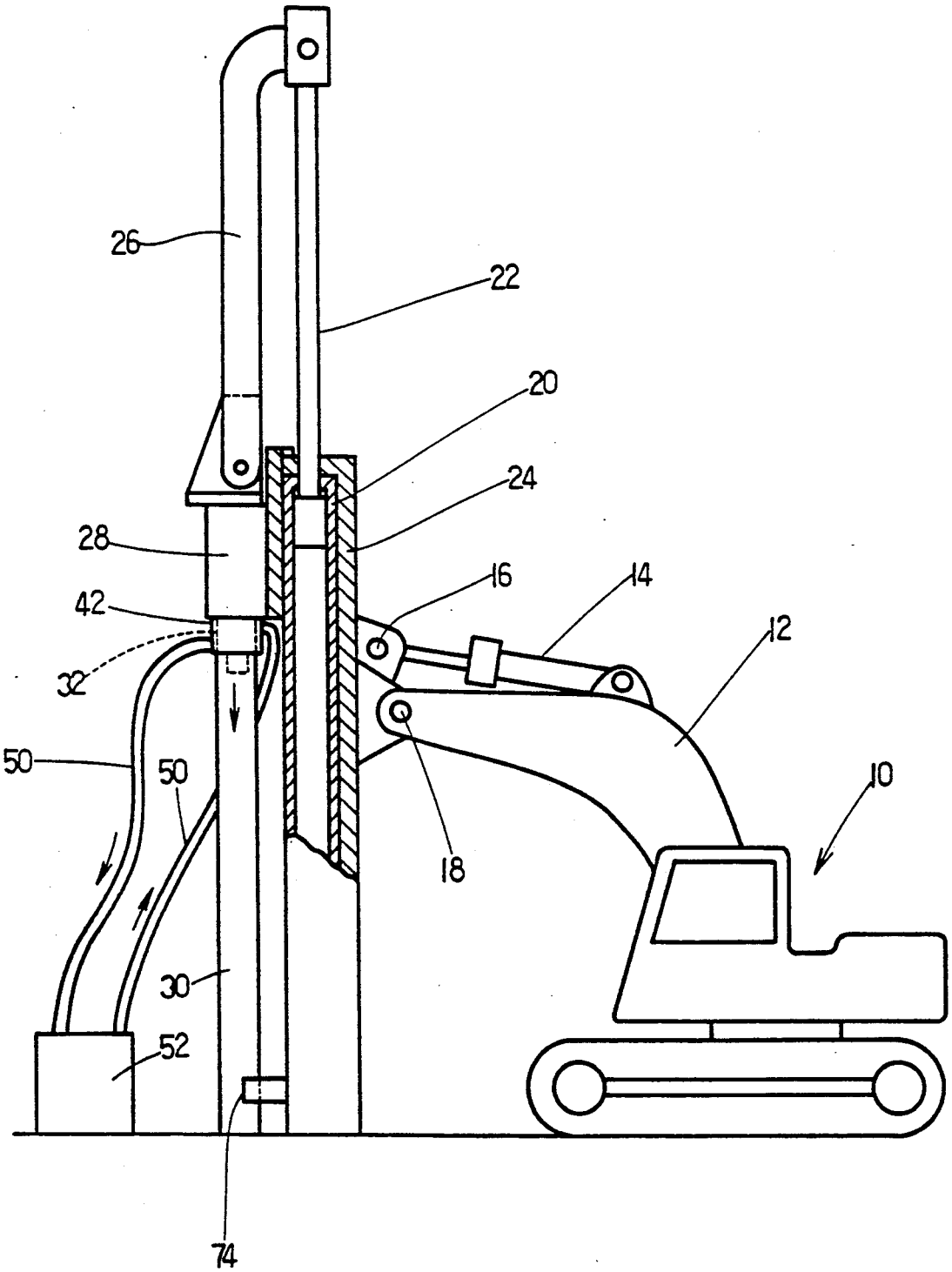
FIG. 2 is a sectional view partly broken away showing the first embodiment of the pile driver in use.

FIG. 2 shows an embodiment of a pile driver which is mounted on the end of boom 12 of power shovel 10. It is rotatably mounted on pin 16 at an end of oil hydraulic unit 14 of boom 12 and pin 18 at an end of boom 12. It comprises a height adjustment means consisting of frame 24, cylinder 20, rod 22, and connecting member 26 suspended from an end of rod 22. Vibrator 28 can be hydraulically driven to produce a high speed reciprocal motion and generate vibrations of about 400 cycles per minute. It has an oil hydraulic driver (not shown) and a hammer 29 (FIG. 1). Adapter 32 is disposed between vibrator 28 and driven member 30, such as a pile to be driven into the ground.

As shown in FIG. 1, adapter 32 is an integral member made of steel including accessory parts secured by welding or the like. As shown in FIG. 1, it includes projection 34 fitted in the head portion of driven member 30, such as a pile, and an oil accommodation chamber 38 accommodating oil 36. Oil accommodation chamber 38 of adapter 32 has its bottom provided with an integral head portion 44, which is hammered by hammer 29 of vibrator 28. Oil accommodation chamber 38 is filled with oil 36 to a level such that head portion 44 is immersed in oil 36. A cap (unnumbered) seals the top of oil accommodation chamber 38. An opening is provided in the cap above head portion 44 through which hammer 29 is inserted. The cross-sectional shape of the opening conforms to the cross-sectional shape of the hammer to prevent loss of oil 36 and to aid in guiding hammer 29.

Cooling unit 42 is provided such that it surrounds oil accommodation unit 30. Cooling unit 42 has a cylindrical double-walled structure, through the inside of which cooling water 40 is circulated. Unit 42 has its lower end provided with a lower water inlet 46 and its upper end provided with an upper water outlet 48. Cooling unit 42 is connected via hose 50 to circulating unit 52 (FIG. 2) having a pump and a heat exchanger.

Figure 3:
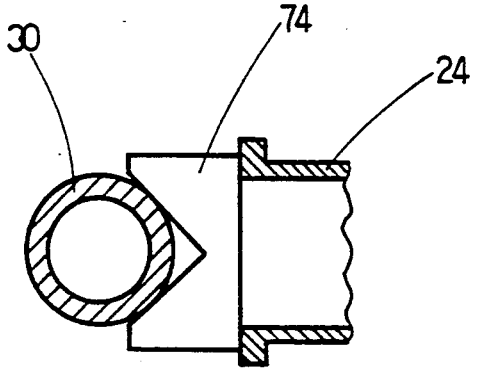
FIG. 3 is a sectional view showing a guide bracket in the first embodiment.

In this embodiment of pile driver, as shown in FIGS. 2 and 3, guide bracket 74 is mounted on the lower end of frame 24 in contact with driven member 30 for guiding driven member 30 in the driving direction.

In the use of this embodiment of pile driver, frame 24 is secured in position at a predetermined angle by moving pin 16 of oil hydraulic unit 14 relative to pin 18 of boom 12 of power shovel 10. Then vibrator 28 is positioned at a selected height by operating the aforesaid height adjustment means. Then, driven member 30, for instance a steel pipe to be driven into the ground, is held in contact with guide bracket 74, and adapter 32 is set on the head portion of driven member 30. Then, vibrator 28 is operated by an oil hydraulic driver (not shown), and circulating unit 52 is operated to prevent the temperature of oil 36 from rising due to absorbing energy produced by the impacts of hammer 29 with head portion 44. Impacts between hammer 29 and head portion 44 of adapter 32 produce energy in the form of vibrations and noise. Since the impacts occur beneath the surface of oil 36, oil 36 absorbs the impact energy. This absorption of energy raises the temperature of oil 36. Oil 36 is cooled to prevent it from being elevated in temperature enough to eventually reach its ignition point and be burnt.

With this embodiment of pile driver, noise and vibrations produced by the impacts between hammer 29 of vibrator 28 and head portion 44 of adapter 32 fitted on the head portion of driven member 30 are absorbed by oil 36 and are prevented from escaping to the outside environment. Since oil 36 is cooled by cooling water 40, its temperature cannot rise to the point of ignition. In addition, since cooling water 40 enters cooling unit 42 through lower water inlet 46 and leaves the unit through upper water outlet 48, no air layer is permitted to form in the unit, thus prohibiting any resonance of vibrations therein. Further, the position and direction of driving are restricted by guide bracket 74, and thus the angle of driving driven member 30 is strictly controlled.

Figure 4:
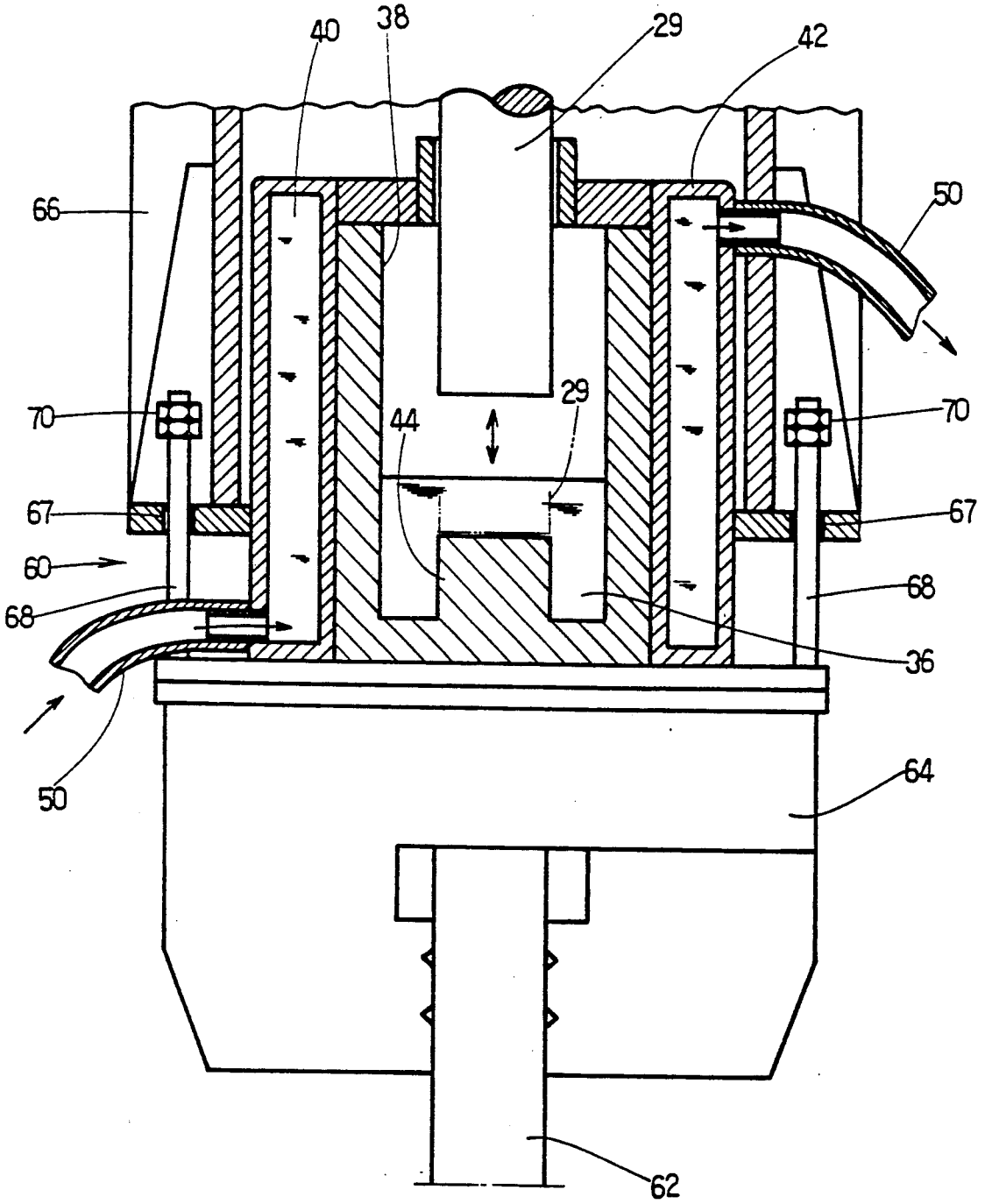
FIG. 4 is a sectional view showing a hammer unit and an adapter in a second embodiment of the invention.

A second embodiment of the invention will now be described with reference to FIG. 4. Parts similar to those in the first embodiment are designated by like reference numerals. In this embodiment, the driven member 62 is a corrugated steel plate. As shown in FIG. 4, adapter 60 is provided with chuck 64 for holding driven member 62, i.e., the corrugated steel plate. Chuck 64 is mounted for vertical movement on frame 66 of the vibrator at a predetermined spacing therefrom by nut 70 and bolt 68, the latter being passed through hole 67. The impact transmitting bottom surface of the adapter is configured to correspond with the configuration of its contacting surface, in this case the top surface of chuck 64. Cooling unit 42 and the other structures are the same as shown in FIG. 1.

Again, with this embodiment of pile driver, driven member 62, i.e., the corrugated steel plate, can be driven quietly and at high speed.

Figure 5:
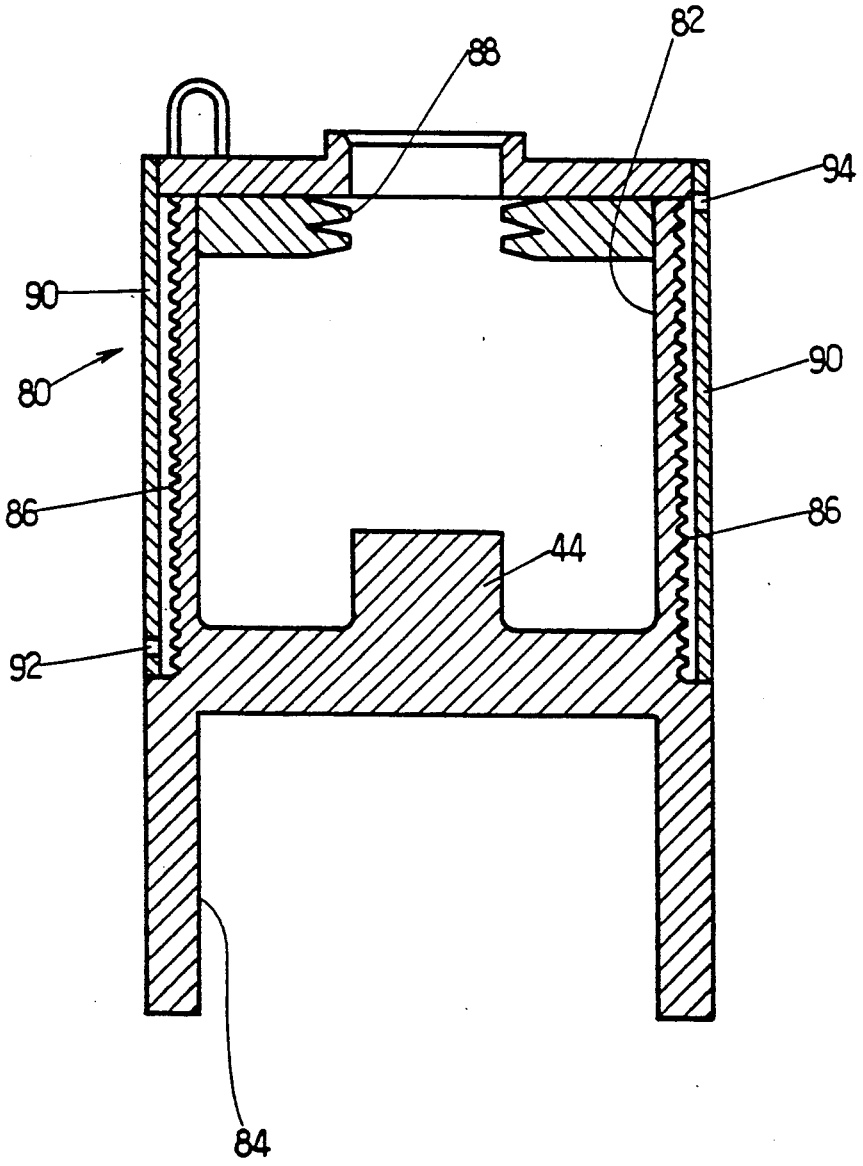
FIG. 5 is a sectional view showing a hammer unit and an adapter of a third embodiment according to the invention.
Figure 6:
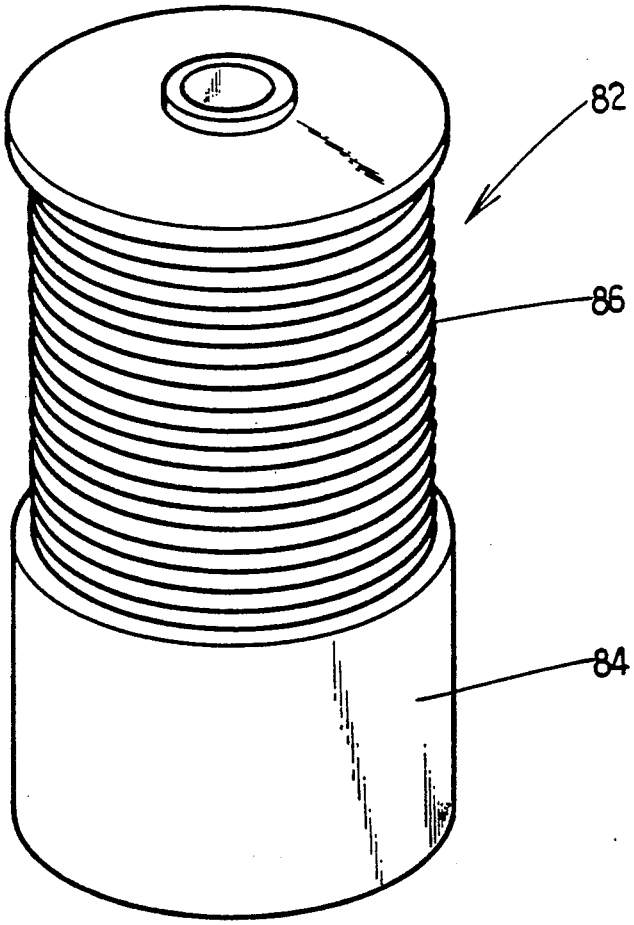
FIG. 6 is a perspective view showing an oil accommodation chamber in the third embodiment.

Now, a third embodiment of the invention will be described with reference to FIGS. 5 and 6. In this embodiment, adapter 80 is provided with engagement portion 84 which is configured to conform to the shape of the driven member and, in operation, is fitted on the driven member. The wall of the oil accommodation chamber 82 has its entire outer periphery formed with grooves 86 for enhancing heat transfer from oil 36 to the water 40 circulating between grooves 86 and side wall member 90, which is disposed on the outer side of oil accommodation chamber 82 and surrounds grooves 86. A cooling unit is thus formed in which cooling water is circulated through the space defined by side wall member 90 and grooves 86 of oil accommodation chamber 82. Oil seal 88 made of metal or synthetic resin is mounted on the inner side of the hammer receiving opening for scraping off oil attached to the hammer.

In this embodiment of pile driver, the cooling unit formed around oil accommodation chamber 82 is simplified in structure. Grooves 86 permit enhanced heat radiation effects to be obtained and permit effective absorption of oil heat. Thus, it is possible to cool the oil sufficiently even if the duration of use of the hammer is extended or if the impact energy is increased at the time of pile driving.

The structure of the pile driver per se is irrelevant, according to the invention, so long as the hammer impacts in a chamber which is at least partially filled with oil, which oil absorbs impact energy, such as that produced by vibrations and noise. The driven member is by no means limited to those noted above, and various other members may be utilized. Further, according to the invention it is possible that a cooling media other than water may be used as well.

What is claimed is:

1. A method of driving a member into the ground by hammering a head of the member, which comprises the steps of:
   - providing a hammer for driving the head of the driven member;
   - providing a vibrator for providing an impact force to the hammer;
   - providing between the hammer and the driven member an adapter for transmitting a hammering force of the hammer to the driven member;
   - providing the adapter with an oil accommodation chamber;
   - providing the oil accommodation chamber with a head portion to be hammered by the hammer;
   - filling the oil accommodation chamber with oil to a level above the head portion; and
   - causing striking of the head portion with said hammer while cooling the neighborhood of the adapter;
   - thereby effecting a driving of the driven member with the hammer.

2. An apparatus for driving a driven member into the ground by hammering a head of said driven member, comprising:
   - a hammer;
   - means for reciprocating said hammer; and
   - an adapter provided between said hammer and said driven member for transmitting a hammering force of said hammer to said driven member, said adapter comprising:
   - a body means including means having means for defining an internal chamber;
   - said internal chamber defining means having an opening through which said hammer is inserted into said internal chamber;
   - said internal chamber having an impact surface adapted to be impacted by said hammer; and
   - an energy absorbing liquid partially filling said internal chamber such that said impact surface is immersed in said liquid.

3. An apparatus as in claim 2, wherein said energy absorbing liquid is oil and said internal chamber is surrounded by a cooling unit.

4. An apparatus as in claim 3, comprising sealing means mounted adjacent said opening for scraping off oil attached to said hammer.

5. An apparatus as in claim 3, wherein said cooling unit comprises of a double-walled chamber through which a cooling media is circulated by a circulating means.

6. An apparatus as in claim 5, wherein said internal chamber is laterally defined by the inner wall of said double-walled chamber and grooves are formed on the external surface of said inner wall.

7. An apparatus as in claim 6, wherein said cooling media enters said double-walled chamber through an inlet at a lower end of said double-walled chamber and exits through an outlet at an upper end of said double-walled chamber.

8. An apparatus as in claim 7, wherein said cooling media comprises water.

9. An apparatus as in claim 5, wherein said cooling media enters said double-walled chamber through an inlet at a lower end of said double-walled chamber and exits through an outlet at an upper end of said double-walled chamber.

10. An apparatus as in claim 9, wherein said cooling media comprises water.

11. An apparatus as in claim 2, wherein said body means includes means defining a force transmitting surface which is configured to correspond to the head of the driven member.

12. An apparatus as in claim 2, wherein the driven member is held by a chuck, and said body means includes means defining a force transmitting surface which is configured to correspond to a force receiving surface of said chuck.

13. An apparatus as in claim 2, wherein said impact surface comprises a raised head which is raised relative to a surrounding surface, and a level of said energy absorbing liquid is above said raised head.

14. For use with a pile driver having a reciprocating hammer for driving a driven member, an adapter comprising:

body means;

said body means having means defining a force transmitting surface;

said body means further including means defining an internal chamber having an opening therein through which said hammer is inserted into said internal chamber;

said internal chamber having an impact surface adapted to be impacted by said hammer; and said internal chamber being adapted to be partially filled with an energy absorbing liquid such that said impact surface is immersed in said liquid.

15. An adapter as in claim 14, wherein said energy absorbing liquid is oil, and said internal chamber is surrounded by a cooling unit.

16. An adapter as in claim 15, comprising sealing means mounted adjacent said opening for scraping off oil attached to said hammer.

17. An adapter as in claim 16, wherein said cooling unit comprises a double-walled chamber adapted to have a cooling media circulated therethrough.

18. An adapter as in claim 17, wherein said double-walled chamber is adapted to have said cooling media enter through an inlet at a lower end of said double-walled chamber and exit through an outlet at an upper end of said double-walled chamber.

19. An adapter as in claim 17, wherein heat transferring grooves are formed on a wall between said internal chamber and said double-walled chamber, said grooves extending into said double-walled chamber.

20. An adapter as in claim 14, wherein said impact surface comprises a raised head which is raised relative to a surrounding surface, and the level of said energy absorbing liquid is above said raised head.

* * * * *